US008814214B2

(12) United States Patent
Holland et al.

(10) Patent No.: US 8,814,214 B2
(45) Date of Patent: Aug. 26, 2014

(54) APPARATUS AND DEVICE FOR PROVIDING BOOK PROTECTION

(76) Inventors: Orly Holland, Ra'anana (IL); Yair Moshe Holland, Ra'anana (IL)

( * ) Notice: Subject to any disclaimer, the term of this patent is extended or adjusted under 35 U.S.C. 154(b) by 0 days.

(21) Appl. No.: 13/313,194

(22) Filed: Dec. 7, 2011

(65) Prior Publication Data

US 2012/0139228 A1 Jun. 7, 2012

Related U.S. Application Data

(60) Provisional application No. 61/420,482, filed on Dec. 7, 2010.

(51) Int. Cl.
*B42D 3/04* (2006.01)
*B42D 3/00* (2006.01)

(52) U.S. Cl.
CPC ..... *B42D 3/045* (2013.01); *B42D 3/004* (2013.01)
USPC ..... 281/20; 281/51

(58) Field of Classification Search
CPC ..... B42D 3/004; B42D 3/045
USPC ..... 281/20, 51, 42; 206/586, 453, 451; 24/67 R–67.9, 67 CF; D19/65
See application file for complete search history.

(56) References Cited

U.S. PATENT DOCUMENTS

| | | | | | |
|---|---|---|---|---|---|
| 91,570 | A | * | 6/1869 | Sewell | 281/20 |
| 230,256 | A | * | 7/1880 | Emerson | 281/20 |
| 661,328 | A | * | 11/1900 | Taylor | 281/42 |
| 2,989,023 | A | * | 6/1961 | Ellingsen Florence G | 281/42 |
| 3,720,035 | A | * | 3/1973 | Rutter | 206/453 |
| 4,402,530 | A | * | 9/1983 | Daguerre | 281/45 |
| 4,735,438 | A | * | 4/1988 | Demarest, Jr. | 281/42 |
| 4,778,201 | A | * | 10/1988 | Kouno et al. | 281/42 |
| 5,950,283 | A | * | 9/1999 | Sato | 24/67 R |
| 2004/0262908 | A1 | * | 12/2004 | Nobata | 281/42 |

* cited by examiner

*Primary Examiner* — Kyle Grabowski

(57) ABSTRACT

A book protection apparatus and method are provided, that include a pair of substantially right angled sheets configured in a parallel fashion, the sheets being joined by a joining mechanism having a tension setting mechanism configured between the pair of sheets, to enable forcibly coupling the binding device to a coupled corner of a book.

1 Claim, 2 Drawing Sheets

APPARATUS AND DEVICE FOR PROVIDING BOOK PROTECTION

CROSS REFERENCE TO RELATED APPLICATIONS

This application claims priority from U.S. Provisional Patent Application No. 61/420,482, filed 7 Dec. 2010, entitled "APPARATUS AND METHOD FOR PROVIDING BOOK COVER CORNER PROTECTION", which is incorporated in its entirety herein by reference.

FIELD OF THE INVENTION

The present invention relates to apparatus and devices useful in protecting hooks. Specifically, embodiments of the present invention relate to apparatuses and devices that provide enhanced protection of books and book corners.

BACKGROUND OF THE INVENTION

A book, physically, is typically a set or collection of written, printed, illustrated, or blank sheets, made of ink, paper, parchment, or other materials, usually fastened together to hinge at one side. In 2010, Google estimated that since the invention of printing, approximately 130,000,000 unique titles had been published.

Modern paper books are generally printed on papers which are designed specifically for the publication of printed books. Typically, books papers are light weight papers specified by their caliper/substance ratios (volume basis). Different paper qualities are used as book paper depending on type of book. As such, common paper grades used include Machine finished coated papers, wood free uncoated papers, coated fine papers and special fine papers.

Whether books are hardback or paper back, and whether they are large or small, thick or thin or of various materials and dimensions, there is a pressing need to protect books so as not to bend the books, expose the pages to ware and tear etc. This is particularly necessary in the case of soft cover books, where a paperback or paper based cover is used.

It would be highly advantageous to have a simple and easy mechanism for protecting book covers and books from bending, fraying, ripping, and otherwise getting damaged.

SUMMARY OF THE INVENTION

There is provided, in accordance with an embodiment of the present invention, an apparatus and device are provided to enable book protection. The book binder protection device (1), according to some embodiments, includes a pair of substantially right angled sheets (2) configured in a parallel fashion, the sheets being joined by a joining mechanism having a tension setting mechanism configured between the pair of sheets, to enable forcibly coupling the binding device to a coupled corner of a book.

In further embodiments, the pair of right angle sheets (2) and joining mechanism are constructed from a single piece of material. In other embodiments the pair of sheets and joining mechanism are constructed from one or more materials from metal, silicon, rubber, plastic, glass or other suitable materials or combinations of materials In some embodiments, the book binder protection device (1) includes one or more maneuvering arms—pair of opening arms (4)—attached to the pair of sheets (2) to enable the sheets to be forcibly coupled to a coupled corner of a book. In further embodiments the arms are adapted to be able to lie flat on a book surface after coupling. In other embodiments the arms are adapted to be able to lock the sheets in place after coupling to a coupled corner. In still further embodiments the arms are adapted to be able to temporarily secure the sheets in place after coupling to a coupled corner. According to some embodiments, the arms are adapted to be able to be released to enable decoupling of the sheets from a coupled corner.

In accordance with some embodiments, a book protection apparatus is provided, that includes two or more corner binding devices, each device including a pair of substantially right angled sheets configured in a parallel fashion, the sheets being joined by a joining mechanism having a tension setting mechanism configured between the pair of sheets, to enable forcibly coupling the binding device to a coupled corner of a book; and two or more tension bands with suitable tension strength to enable suitable force to be applied between the binding devices when the binding devices are placed on opposite coupled corners of a book, thereby maintaining a book in a closed status until released.

In further embodiments, the tension bands include materials such as elastic hands, strings, silicon connectors and other elastic quality connectors with suitable tension strength.

In some embodiments the sheets, joining mechanisms and tension bands are constructed from a single piece of material.

In further embodiments the book protection apparatus includes one or more maneuvering arms attached to the pair of sheets to enable the sheets to be forcibly coupled to a coupled corner of a book. In some embodiments the binding devices may be coupled to two external coupled corners of a book, two internal coupled corners of a book, and/or may be coupled respectively to an internal and an external coupled corner of a book.

In further embodiments the book protection may include arms adapted to maneuver sheets into place around a coupled corner. In further embodiments the arms may be adapted to be able to secure the sheets in place after coupling to a coupled corner. In still further embodiments the arms may be adapted to be able to be released to enable decoupling of the sheets from the coupled corner.

BRIEF DESCRIPTION OF THE DRAWINGS

The principles and operation of the system, apparatus, and method according to the present invention may be better understood with reference to the drawings, and the following description, it being understood that these drawings are given for illustrative purposes only and are not meant to be limiting, wherein.

Figure 1A:
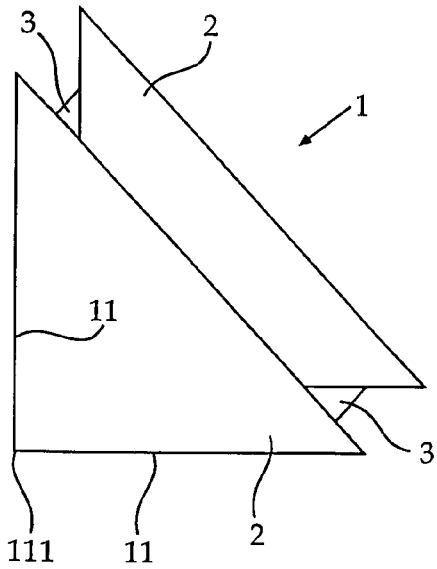
FIGS. 1A and 1B are schematic diagrams of book binding devices (1), according to some embodiments.

It will be appreciated that for simplicity and clarity of illustration, elements shown in the drawings have not necessarily been drawn to scale. For example, the dimensions of some of the elements may be exaggerated relative to other elements for clarity. Further, where considered appropriate, reference numerals may be repeated among the drawings to indicate corresponding or analogous elements throughout the serial views.

DETAILED DESCRIPTION OF THE INVENTION

The following description is presented to enable one of ordinary skill in the art to make and use the invention as provided in the context of a particular application and its requirements. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed. In other instances, well known methods, procedures, and components have not been described in detail so as not to obscure the present invention.

The word/phrase "binder clip" as used herein may encompass a binder clip, or a banker's clip, bulldog clip, foldback clip, or other similar device for binding sheets of paper together, optionally using folding handles or a more rigid structure to "lock" in place, thereby leaving the paper being held intact and being able to be removed quickly and easily. The term "book" as used herein may refer to books, magazines, piles of paper or other stacks of items requiring binding. The term top of the book generally refers to the upper side, or top of the page where the text starts. The term bottom of the book generally refers to the lower side, or bottom of the page where the text ends. The term front of the book generally refers to the anterior or front of the book, where the front cover is generally located, while the term back of the book generally refers to the posterior or hack of the book, where the back cover is generally located. The phrase"coupled corner" as used herein may refer typically to the back and front corners together, such that two lower or two upper corners may be held, fastened or coupled together.

A binder clip is a typically a strip of spring steel sheet metal bent into the shape of an isosceles triangle, optionally with loops at the apex, such that one point or side is left open able. Through the two ends of the open side, two wire arms (typically pieces of stiff wire) are typically looped through the loops to enable easy gripping and maneuvering of the end pieces, thereby facilitating the opening and closing of the binder clip. Tension along the base of the triangle forces the two sides closed, and the loops prevent the sharp steel edges from cutting into the paper. The slots (typically two) cut in each loop are shaped so that the wire handles can be folded down once the clip has been attached, and the spring force of the wire holds them down on the surface of the paper. This holds the clip relatively flat, for easier stacking of paper. One handle can also be folded down while the other remains ups to allow the stack of papers to be hung up. The handles can also be removed altogether by squeezing them sideways and pulling them out, allowing for more permanent binding. As compared to a paper clip, the binder clip is able to bind sheets of paper more securely, and is also resistant to rust.

Embodiments of the present invention enable book, magazine, pamphlet or paper pile protection, using an enhanced clip binder technology to quickly bind and release book corners.

Figure 1B:
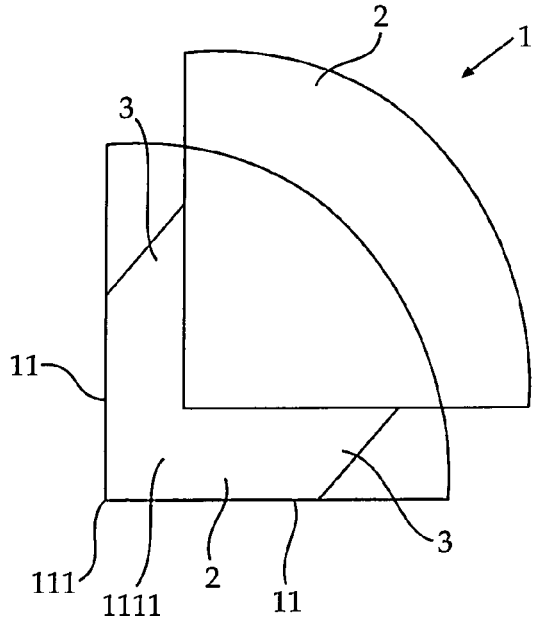

Reference is now made to FIGS. 1A and 1B which describe a book binder protection device (1). The book binder protection device (1) comprises of a pair of right angle sheets (2) which are connected to each other in parallel by a joint mechanism (3). As can be seen in FIG. 1A, the book binder protection device (1) may include a selectively shaped spring material element, such as a shaped sheet, typically steel sheet metal, but appropriate silicon, plastic or rubber may be used. The sprung shaped sheet is typically designed to be the shape of two connected substantially right angled triangles, for example, having one substantially 90° internal angle or right angle, such that the respective triangle legs are connected by the sheet metal, however the two open sides, the sides opposite the respective right angles, which are the longest sides in the respective right-angle triangles, or hypotenuse are not intrinsically connected, yet are pulled together by the tension in the spring. The two open sides may be opened or separated to allow installation around the anterior (front) and posterior (back) corners of an object, such as a book, to be temporarily bound. Typically there is a substantially 90° degree inner angle between the two connected triangles, allowing the sheet to be installed and closed over the coupled corner i.e. typically the back and front corners together of a book or a notebook, to protect the coupled corner of the cover and the papers from wrinkling, folding, tearing, or other damage, defection and/or widening especially in the open bottom corner. In addition to the protection of the coupled corners of a book or pile of paper, the binder protector device keeps the whole book or pile from damage by keeping it in a closed and temporarily locked position.

As can be seen in FIG. 1B, in some embodiments the open sides, opposite the right angles, may be rounded, for example in the shape of a quarter circle design or other suitable non straight designs. Other designs for the open sides may be used, such as decorative designs and other designs of choice. In further embodiments the right angle of the book binder protection device (1) may be rounded or otherwise shaped.

Figure 2A:
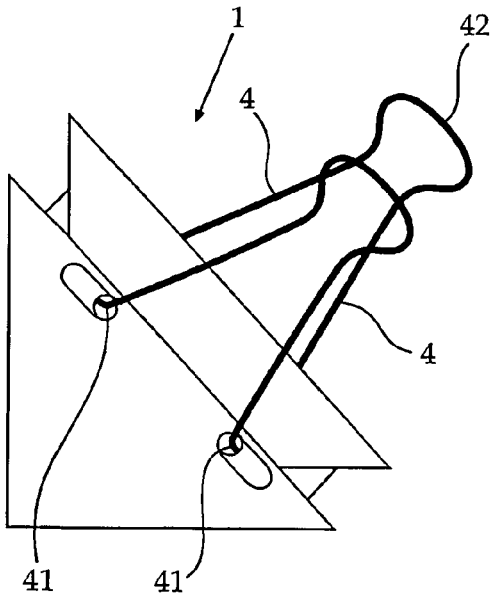
FIGS. 2A and 2B are further schematic diagrams of a book binding device (1) with attachment arms (2), according to some embodiments.
Figure 2B:
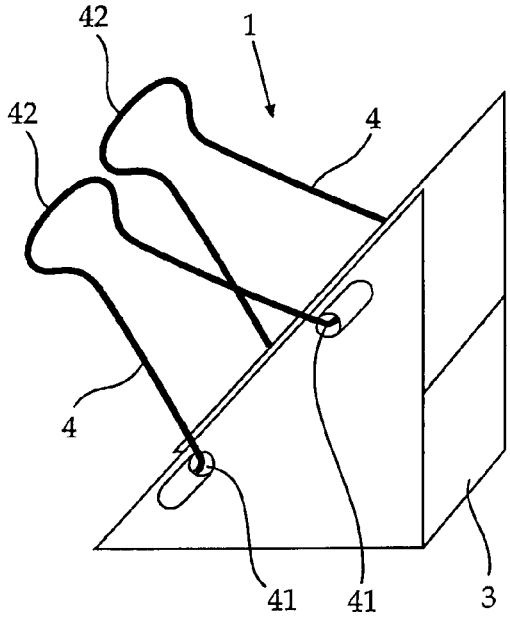

Reference is now made to FIGS. 2A and 2B which are schematic block diagrams illustration of the book binder protection device (1), according to some embodiments. As can be seen in FIGS. 2A and 2B, a book binder protection device (1) with pair of opening arms (4) is provided in one example, wherein a substantially 90° inner angle is formed between the inner meeting point of the two open sides. As shown in the figures, the two open sides are in open mode or view, however the spring tension draws the open sides together around an object which is to be bound. Since the two open sides are typically in closed mode, being pressured by the spring effect built into the bent sheet metal design, opening of the open sides to allow for deployment over a coupled (i.e. back and front) book corner etc. requires leveraging power to pressure the sides open. Such leveraging may be achieved using the pair of opening arms (4), which may typically be squeezed or pressured to provide a negative force on the open sides to cause the space between them to be expanded. When in place, the maneuvering arms or wings may be moved to rest on the surface of the book or stack being bound, for example, towards the middle of the cover, on both the top and bottom sides of the book or stack being bound, to provide a flat and supportive position vis a vis the book cover. Such positioning of the arms may further help the arms to stay substantially out of the way of the user, by not extending beyond the cover borders or at a substantial height above the surface being bound. Of course, other arm or maneuvering elements may be used. It is clear from the above explanation and also from the FIGS. 2A and 2B that each opening arm (4) is attached to each of right angles sheet (2).

Figure 3A:
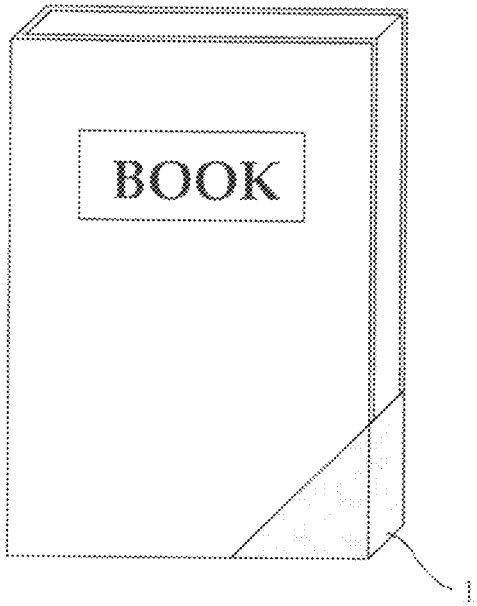
FIGS. 3A and 3B are schematic diagrams of an application of a book binding device (1) on a book corner, according to some embodiments.
Figure 3B:
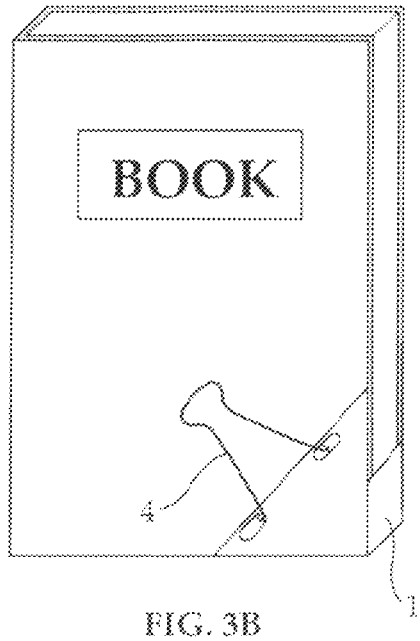

FIGS. 3A and 3B refer to graphic illustrations of an application of the book binder protection device (1) in use, according to some embodiments. As can be seen in the figures, the 3 Dimensional triangle type shape device is typically placed on a coupled outer (external) corner of a book, opposite the book's spine, such that the device holds both the bottom anterior (front) and posterior (bottom) corners of the book. In other embodiments the top anterior and posterior corners may be bound by a book cover binder protector device. In yet further embodiments a book cover binder protector device may be attached to both the top and/or bottom anterior and/or posterior corners.

In some embodiments, the book binder protection device (1) may be made of various materials or combinations of materials, to suitable enable fitting snugly or tightly around a front and back book corner of a closed book, optionally with properties such as material pressures to hold the coupled book corners fast and prevent unintentional releasing. For example, silicon, metal, plastic or other suitable flexible materials may be used to provide a spring or tension effect, thereby allowing the book cover binder protector device to be snugly or closely fitted on a variety of books, of different sixes, shapes, materials etc.

According to some embodiments, the inside surfaces of the book cover binder protector device, which comes into contact with the book, may be coated with a smooth material to enable harmless gripping of the book cover. In other embodiments the inside surfaces of the device may be coated with a rough material to enable enhanced gripping of the book cover to avoid easy slipping off or otherwise being dislodged.

According to additional embodiments, book cover binder protectors may be used in a variety of sizes so as to be compatible with a range of book, notebook, magazine, pile of paper sizes, thickness etc. The sheet portion, whether constructed from metal or other materials, may be black oxide coated, or coated by other colors or materials, optionally allowing for decorative schemes to be used.

According to some embodiments, the sheet steel may be made of stainless steel, and may be finished in nickel, silver or gold. The handles in some embodiments may typically be nickel plated, yet other plating may be used. In some embodiments the outside surfaces of the book cover binder protector device are covered with rust-free material. In still further embodiments the book cover binder protector device can be made from silicon etc. to tightly wrap around or hold the book and both corners, for example, using an expansion mechanism such as the material stretch tension to fit around the book cover, in accordance with a variety of book thicknesses. Other suitable materials may be likewise used.

Figure 4A:
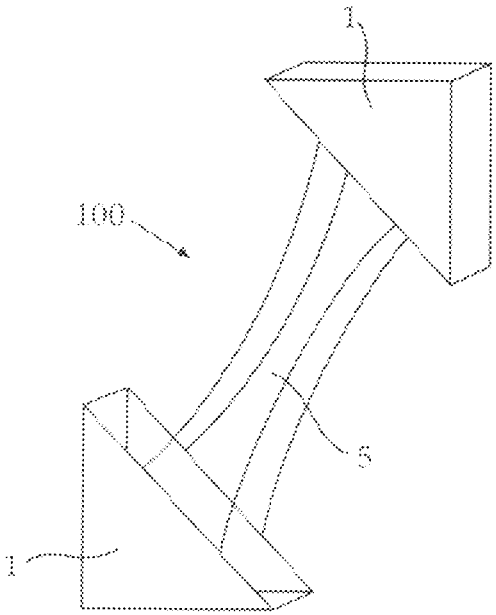
FIGS. 4A and 4B are graphical illustrations of a device designed to protect opposite hook corners (100) comprises couple of book binding device (1) including—pair of tension bands (5) according to some embodiments.
Figure 4B:
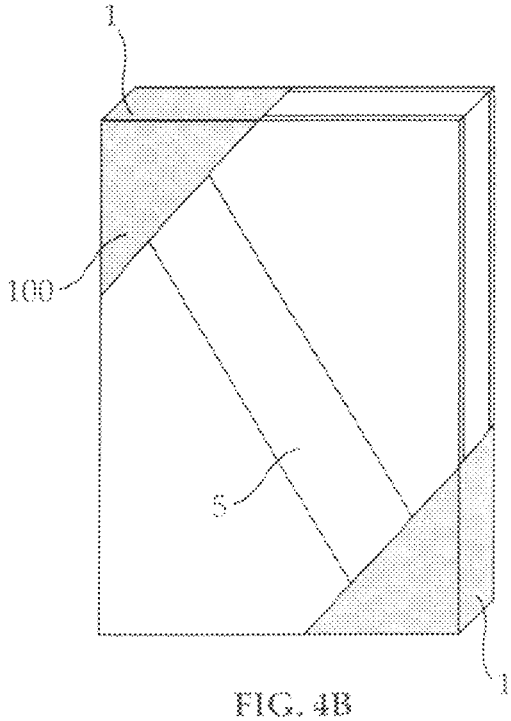

According to some embodiments, a book binding device without arms may be used to bind a book or papers. In such an embodiment, as can be seen with reference to FIGS. 4A and 4B, two or more binder devices may be connected using two or more tension bands (5) or other coupling mechanisms, such as durable elastic bands, strings, silicon connectors or other elastic quality connectors with suitable tension strength.

Tension bands may, for example, be attached to the respective book cover binder protector devices so as to enable suitable tensions to allow fitting to various book sizes, masses, materials etc. For example, the bands may be configured so as to facilitate book cover binder protector devices to be placed on diagonally opposite corners of a book, e.g. external corner of book, opposite the spine to an internal diagonally opposite corner on the spine, or vertically opposite corners of a book, e.g., external top and bottom corners opposite the book spine.

In one example, the two binder devices may be placed respectively on opposite corners of the book to be bound, such that the tension bands are extended to allow the devices to be placed in tension on their opposite corners. In this way, the corner devices are held in place on the book, by the tension bands pulling the corner devices together. For example, the one book cover binder protector device may be placed on the lower external coupled corner, including both anterior and posterior corners, and the other on the upper spine coupled corner, including both anterior and posterior corners, of a book, connected via the tension strings to hold the two devices in place. Alternatively or additionally, the one book cover binder protector device may be placed on the upper external corner and the other on the lower spine corner of a book, connected via the tension strings to hold the two devices in place.

In other examples, the two binder devices may be placed respectively on vertically opposite corners of the book to be bound, such that the tension bands are extended to allow the devices to be placed in tension on their opposite vertical corners. In this way, the corner devices are held in place on the book, by the tension bands pulling the corner devices together. For example, the one book cover binder protector device may be placed on the lower external coupled corner, including both anterior and posterior corners, and the other on the upper external coupled corner, including both anterior and posterior corners, of a book, connected via the tension strings to hold the two devices in place. Alternatively or additionally, the one book cover binder protector device may be placed on the upper internal (spine side) coupled corner and the other on the lower internal (spine side) coupled corner of a book, connected via the tension strings to hold the two devices in place.

The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

It is understood from the above explanations and from the drawings attached to the application that the invention refers to three embodiments of a book binder protection device (1). The first embodiment is depicted in Drawings Nos. 1A, 1B and 3A. The second embodiment is depicted in Drawings Nos. 2A, 2B and 3B, and the third embodiment is depicted in Drawings Nos. 4A and 4B.

The first embodiment of the invention refers to a book binder protection device (1) comprises of a pair of sheets each having at least one right angle (2), wherein two sides (11) that form said right angle (111) are straight. Wherein said sheets (2) are joined one to each other in parallel by a joining mechanism (3). Wherein said joining is done such that said pair of straight sides (11), of each of said sheets (2), are joined in parallel by means of said joining mechanism (3). Wherein said joining of said sides (11) forms a 90 degree corner (1111) that is designed to receive a corner of a book in closed position and whereby protects the book corner from any damage.

The second embodiment of the invention refers to the book binder protection device (1) described above in the first embodiment, wherein it is also equipped with a pair of opening arms (4) each of which has a connecting end (41) and a pressure end (42). Wherein each of said opening arms (4) is attached to one of said sheets (2) by means of an axial joint. Wherein force applied to said pressure ends (42) of said pair of opening arms (4) causes said sheets (2) to be opened and enable to insert a book corner in between said sheets (2).

The third embodiment of the invention refers to a device designed to protect opposite book corners (100) that is composed of a couple of book binder protection devices (1), as described above in the first embodiment, that are connected to one another by means of pair of tension bands (5). Wherein one end of each of said tension bands (5) is attached to the edge of the sheets (2) of the first device (1) and the other end of each of said tension bands (5) is attached to the edge of the sheets (2) of the second device (1) and enable by that to insert opposite corners of a book into said couple devices (1) and the tension bands cause said devices to fit tightly and firmly over said two diagonally opposite corners of said book.

What is claimed is:

1. A book and a device designed to protect opposite book corners of the book (100) comprising a couple of book binder protection devices (1) and a pair of tension bands (5); wherein each of said book binder protection devices (1) comprise a pair of sheets each having at least one right angle (2); wherein two sides (11) that form said right angle (111) are straight; wherein said sheets (2) are joined one to each other in parallel by a joining mechanism (3); wherein said joining mechanism is done such that said pair of straight sides (11), of each of said sheets (2), are joined in parallel; wherein said joining mechanism of said sides (11) forms a 90 degree corner (1111) that is designed to receive a corner of the book in closed position and whereby protects said book corner; wherein said book binder protection devices are connected to one another by said pair of tension hands (5); wherein one end of each of said tension bands (5) is attached to the edge of said sheets (2) of said book binder protection device (1) and the other end of each of said tension bands (5) is attached to the edge of the sheets (2) of the other book binder protection device (1) whereby enables to insert two diagonally opposite corners of the book into said book binder protection devices (1) whereby said tension bands cause said book binder protection devices to fit tightly and firmly over said opposite corners of said book.

* * * * *